United States Patent [19]

Blake

[11] 4,324,544

[45] Apr. 13, 1982

[54] PROCESS AND SYSTEM FOR DRYING COAL IN A FLUIDIZED BED BY PARTIAL COMBUSTION

[75] Inventor: John H. Blake, Menlo Park, Calif.

[73] Assignee: FMC Corporation, Chicago, Ill.

[21] Appl. No.: 158,857

[22] Filed: Jun. 12, 1980

[51] Int. Cl.[3] ..... F26B 3/08; F27B 15/00

[52] U.S. Cl. ..... 432/14; 432/15; 432/58; 34/10; 110/347; 110/245

[58] Field of Search ..... 34/9, 10, 57 R, 57 A, 34/95; 432/58, 15, 14; 110/245, 347

[56] References Cited

U.S. PATENT DOCUMENTS

| | | | |
|---|---|---|---|
| 2,638,684 | 5/1953 | Jukkola | 34/10 |
| 3,190,627 | 6/1965 | Goins | 34/10 |
| 3,238,634 | 3/1966 | Goins | 34/10 |
| 3,917,444 | 11/1975 | Canthew | 432/29 |
| 3,986,557 | 7/1975 | Seitzer et al. | 34/10 |
| 4,023,280 | 5/1977 | Schora et al. | 432/15 |
| 4,133,636 | 1/1979 | Flynn | 432/72 |
| 4,152,110 | 5/1979 | Jukkola | 432/58 |
| 4,174,947 | 11/1979 | Delessard et al. | 432/58 |
| 4,175,335 | 11/1979 | Avril | 34/128 |
| 4,213,752 | 7/1980 | Seitzer | 432/15 |
| 4,245,395 | 1/1981 | Potter | 34/10 |

*Primary Examiner*—Henry C. Yuen

*Attorney, Agent, or Firm*—Henry M. Stanley; Richard B. Megley

[57] ABSTRACT

A process and system are disclosed for drying coal in a fluidized bed wherein the heat necessary for drying is provided by partial combustion of the coal in the bed. Proper control of the reaction parameters, particularly reaction temperature, provides an acceptably high drying rate along with an acceptably low production of pollutants in the off-gases. A particular embodiment of the invention provides for cooling of the dried coal by mixing such dried coal with an additional stream or additional streams of undried coal.

9 Claims, 3 Drawing Figures

PROCESS AND SYSTEM FOR DRYING COAL IN A FLUIDIZED BED BY PARTIAL COMBUSTION

BACKGROUND OF THE INVENTION

1. Field of the Invention

The present invention relates to a process for continuously drying wet coal to a preselected moisture content. More particularly, it relates to drying a stream of wet particulate coal in a fluidized bed wherein the energy for drying is supplied by partial combustion of the coal itself.

2. Description of the Prior Art

Lignite and subbituminous coals found in the western United States both have a low sulfur content which is desirable to utilities seeking to comply with increasingly strict air-quality standards. Offsetting this advantage, western coals have a high moisture content and resulting low BTU values. Most utilities in the eastern United States have boilers designed for burning eastern coal having a low moisture content. Conversion of these boilers to allow combustion of western coals is expensive and generally results in a reduced steam generating capacity. For these reasons, it is desirable to lower the moisture content of western coals thereby increasing their BTU value and making them compatible for use in boilers presently burning eastern coals.

An additional advantage of drying the coal prior to shipment is to decrease shipping costs because of the resulting weight reduction. The advantages to drying western coals are set forth in detail in the article entitled "*Enriching Western Coals By Thermal Drying and Oil Treatment* by Wegert and Jensen in Coal Age, May 1976.

The drying of particulate coal in a fluidized bed is well known in the prior at. Most often, heated combustion products are used to fluidize the bed and to provide the enthalpy necessary to dry the coal. U.S. Pat. No. 3,755,912 to Hamada et al describes a process wherein the off-gases from a coking oven at a temperature of approximately 250° C. (482° F.) are further heated to approximately 500° C. (932° F.) in a separate furnace and, thereafter, used to fluidize and dry a bed of coal. U.S. Pat. No. 3,190,627 to Goins reveals a fluidized bed dryer having a plurality of burners at the bottom thereof. The burners are gas-fired and provide combustion products directly to the fluidized bed overhead. The gases are in the temperature range from 1000° F. to 3200° F.

Several processes have utilized the combustion of coal to provide the heat necessary to dry the product coal. U.S. Pat. No. 3,896,557 to Seitzer et al provides for collection of coal fines above a fluidized drying bed and the burning of these fines in a separate combustion chamber. The resulting combustion products are used to fluidize the drying bed. Similarly, U.S. Pat. No. 2,638,684 to Jukkola describes a process wherein coal fines are collected above the fluidized bed and directed to the primary combustion zone. Jukkola describes a single vessel having both a combustion zone and a separate coal drying zone. Virtually complete combustion of the coal fines occurs in the combustion zone and the resulting combustion products are directed upward into the coal drying zone where wet coal feed is fluidized and dried.

SUMMARY OF THE INVENTION

The present invention is a process for drying coal carried out in a bed fluidized with an unheated gas containing oxygen, typically air. Continuous combustion of a portion of the coal provides the heat necessary for drying.

This approach has several advantages over the prior art wherein the fluidizing gas is heated outside the fluidized bed and no combustion takes place in the bed itself. Carrying out the combustion in the drying vessel is thermally efficient since no heat is lost in transferring the fluidizing gas to the fluidized bed. Elimination of a separate combustion vessel reduces the capital cost of the system. Finally, combustion may be carried out at a lower temperature since the process does not depend on a high enthalpy content in the fluidizing stream. Combustion takes place throughout the bed and the enthalpy of combustion is transferred directly to the water present eliminating the need for a high combustion temperature. Combustion at a lower temperature is an advantage because fewer contaminants are produced than are produced by high temperature combustion, as found in the prior art.

According to the invention a continuous process is disclosed for drying particulate coal utilizing heat obtained only from controlled combustion of coal within a fluidized bed of particulate coal after the fluidized bed has first been initially fluidized and raised to a temperature between about 400° F.–600° F. The particulate wet coal is maintained fluidized with an unheated fluidizing gas containing oxygen to form the fluidized bed. A sufficient amount of oxygen for combustion is maintained within the fluidized bed so that the bed temperature is controlled within the range between 400° F. and 600° F. whereby the coal is in partial combustion and the temperature is substantially the same throughout the fluidized bed. The fluidizing gas, gaseous coal combustion products and water vapor are withdrawn from above the fluidized bed. The dried coal is withdrawn from the fluidized bed and is maintained in a substantially inert atmosphere. The dried coal is thereafter cooled to a temperature below 140° F.

In a preferred embodiment of the invention, the stream of dry coal discharged from the fluidized bed, which is at a temperature essentially equal to the bed temperature, is mixed with an additional stream of wet particulate coal. Heat from the hot coal stream is transferred to the wet coal stream. The result is that the dry coal is cooled and the wet coal is dried. The amount of wet coal mixed with the dry coal stream is chosen so that the combined stream will have essentially no moisture and a temperature just above the normal boiling point of water. This combined stream may then be mixed with a third stream of wet coal to produce a final product stream with a temperature below the normal boiling point of water. The amount of raw coal mixed in this final stage depends on the desired moisture content of the product stream. A greater amount of coal will result in a higher moisture content and a lower temperature.

In another preferred embodiment of the invention, all raw, wet coal is fed into the upstream end of a mechanical mixer where it is mixed with the hot, dry coal from the fluidized bed dryer. A portion of the combined stream is then recycled as feed to the fluidized bed dryer where partial oxidation occurs to provide the heat necessary for drying. The coal from the dryer is fed to the mechanical mixer.

DESCRIPTION OF THE PREFERRED EMBODIMENT

Figure 1:
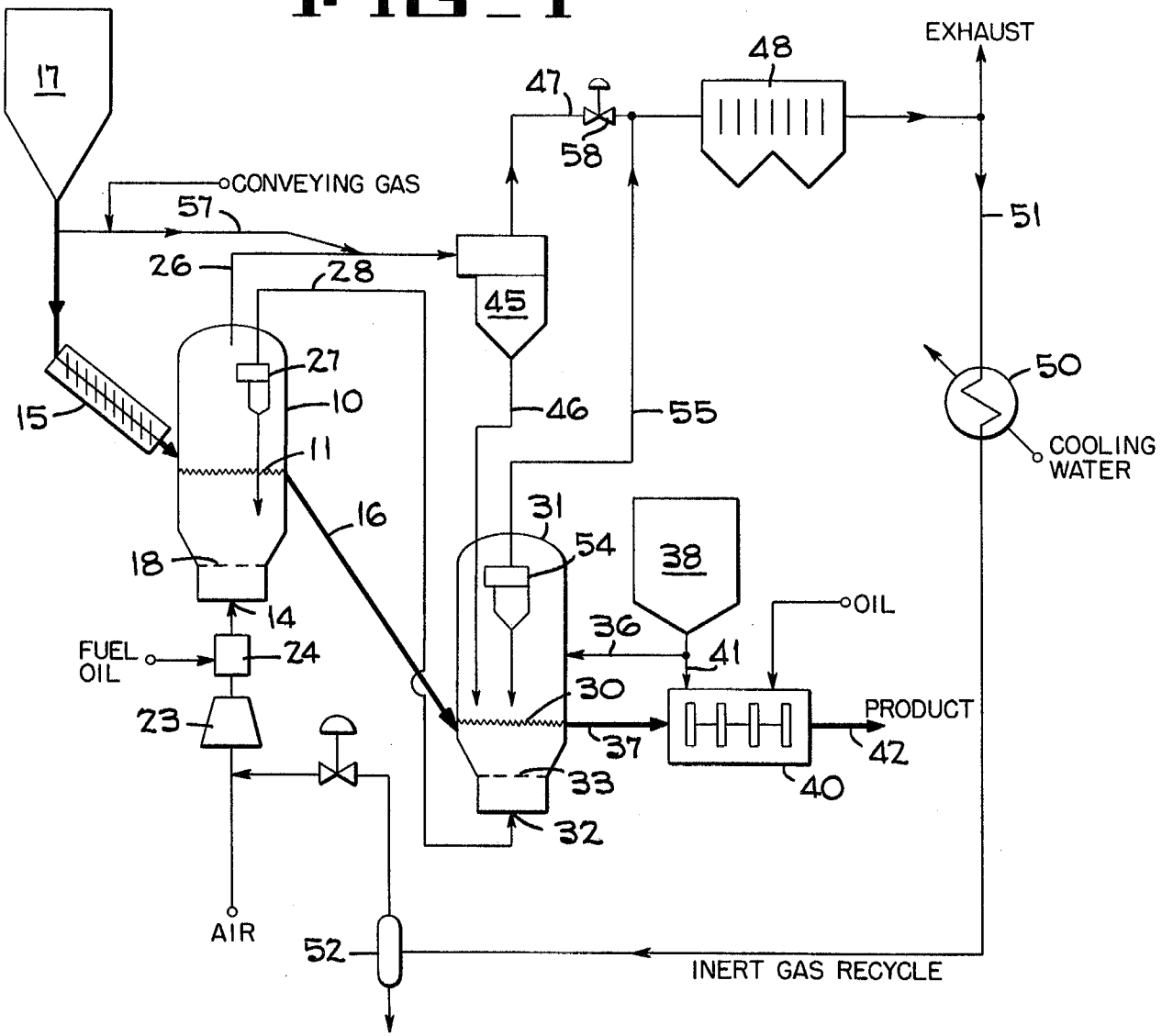
FIG. 1 is a flow diagram illustrating a fluidized bed dryer with first stage cooling accomplished in a second fluidized bed and second stage cooling accomplished in a mechanical mixer.

The present invention stems from the discovery that the low-temperature combustion of coal in a fluidized bed can provide sufficient heat to dry that coal with relatively short retention times and with an acceptably low production of undesired by-products. The success of the process depends on the nature of reaction chemistry, thermodynamics and kinetics which will be briefly discussed hereinafter.

PRINCIPLES OF THE INVENTION

Coal is a collection of many different hydrocarbon molecules and the combustion of coal involves equally numerous reactions. The gaseous reaction products from the combustion of coal include water, carbon monoxide, carbon dioxide, and sulfur dioxide, along with traces of various hydrocarbons. Of the foregoing, strict limits are imposed against the release of carbon monoxide, sulfur dioxide, and hydrocarbons into the atmosphere. The high temperature combustion of coal can produce significant amounts of each of these pollutants. It has been found that by carrying out the partial combustion of coal at low temperatures in a fluidized bed, the production of these undesired products is minimized. For the various coals tested, including both bituminous and subbituminous coals, the production of sulfur dioxide was in all cases lower than 5 ppm, well below applicable emission standards. The production of carbon monoxide is below 1% and hydrocarbons below 1000 ppm. Control of these latter emissions requires only that the exhaust gases be dispersed above ground level.

The amount of heat provided by the combustion of coal at low temperatures is determinative of the amount of coal consumed to provide the necessary heat load. For the various coals tested, including both bituminous and subbituminous coals, an average heat of combustion value was found to be 5200 BTU per pound of oxygen reacted. This relates to an acceptable level of coal consumption of approximately 4% or less by weight in coals containing from 20% to 30% moisture.

While both the reaction chemistry and the reaction thermodynamics favor the low temperature drying of coal by internal combustion is a fluidized bed, it is also necessary that the reaction occur rapidly enough to liberate sufficient heat with a relatively short retention time in the fluidized bed. As reaction temperature is lowered, the reaction rate is reduced. Since a reaction rate varies exponentially with temperature, the combustion of coal and the resulting release of heat occurs much more slowly at low temperatures than at normal combustion temperatures. Tests conducted on samples of various high moisture western coals, however, indicate that the combustion reaction proceeds rapidly enough so that most of the oxygen in the fluidizing gas will react in a fluidized bed of reasonable depth when practical fluidizing velocities are used.

If the oxidation of coal is assumed to be a second-order reaction, the reaction rate equation may be written as follows:

$$R = K[C][O_2]$$

where $R$ = rate of reaction of oxygen, lb./hr. ft.$^3$ $K$ = reaction rate constant, 1/atm. hr.

$[C]$ = concentration of coal in the bed, lb./ft$^3$ $[O_2]$ = partial pressure of oxygen in the fluidizing gas, atm.

Tests on several different subbituminous coals have indicated that the reaction rate constant (K) lies in the range from 0.8 to 1.3 at 450° F. The reaction rate constant for less reactive bituminous coal was found to lie in the range from 0.8 to 1.5 at 550° F. Using the reaction rate equation and knowing the heat released per pound of oxygen reacted, the drying temperature, the fluidizing velocity, and the bed loading, it is possible to calculate the reactor size necessary to dry any given sized stream of wet coal. Such calculations indicate that commercial dryers may be built with capacities up to 700 lb. coal/ft.$^2$ bed area/hr., a more than adequate capacity.

It should be noted that the above reaction rate constants were calculated from coal ground to below 8 mesh. The combustion rate appears to be limited by the amount of coal surface exposed to the fluidizing gas and, therefore, larger coal particles will probably oxidize less rapidly.

For the sake of safety and efficiency, coal dried in a fluidized bed operated on the principles just described must be cooled prior to storage. Dry coal emerging from the fluidized bed reactor will be at a temperature approximately equal to the bed temperature, that is, in the range from 400° to 600° F. Such hot coal must be maintained in an essentially inert atmosphere (oxygen content below about 4%) to avoid possible ignition or explosion. The coal must be cooled, therefore, before it is introduced into an atmosphere with a higher oxygen content. Additionally, it is desirable to recover the heat contained in this hot mass of coal in a useful manner.

The approach of the present invention is to mix the hot, dry mass of coal emerging from the fluidized bed dryer with an additional amount of wet, particulate coal. The result is that the hot coal is cooled and the wet coal is dried. For efficient heat transfer and to reduce the size of equipment required, it is best to carry out this cooling operation in two stages. The first mixing stage adds an amount of wet coal sufficient to lower the temperature of the combined mass to just above the normal boiling point of water. Retention time in the mixer is sufficient to insure that essentially all moisture is evaporated from the wet coal. A second stage cooler mixes the combined stream from the first stage cooler with an additional stream of wet coal to lower the temperature of the product stream below the normal boiling point of water. The amount of raw coal introduced in the final mixing stage will be chosen to yield the desired end temperature typically below 140° F.

The present invention may be practiced with a variety of specific approaches. Three specific approaches will be presented in detail hereinafter. It will be appreciated that the invention is not limited in any way by the specifics set forth.

AN EMBODIMENT OF THE INVENTION WHEREIN FIRST STAGE COOLING IS ACCOMPLISHED IN A FLUIDIZED BED

FIG. 1 illustrates the process and equipment necessary to transform a continuous stream of wet particulate coal into a stream of dry coal ready for storage, transport or immediate use.

The heart of the process is a fluidized bed dryer 10. A bed of ground coal 11, typically sized $\frac{1}{4}''\times 0$, is maintained within dryer 10 and fluidized by an air stream entering through a port 14 at the bottom of the dryer. Coal is continuously fed into the bed 11 by by means of screw conveyor 15 and discharged to a first stage cooler 31 through an exit line 16. Flow through line 16 is by gravity and line 16 is connected to the dryer 10 at a height corresponding to the desired bed level for the fluidized bed 11. Thus, the throughput of coal through the dryer may be adjusted by varying the speed of the feed screw conveyor 15 without affecting the bed level since any increase in input will be automatically reflected in an increased overflow through line 16.

The diameter of the fluidized bed dryer 10 is 18 feet with a bed area of approximately 250 ft.$^2$. A throughput of 100 tons/hr. of product coal may be achieved with a fluid bed level of 12 feet.

The coal must be ground prior to being fed to the dryer 10, and it might be desirable to provide a grinding mill directly upstream of conveyor 15. For convenience, however, FIG. 1 shows a coal hopper 17 which will be assumed to contain previously ground coal. The coal bed 11 is supported on a pipe-type grid 18 which serves to evenly distribute the fluidizing gas over the bottom of the bed. A gas fluidizing velocity in the range from 1 to 3 feet per second is adequate to support the bed without causing excessive carryover.

Temperature control within the bed is achieved in three ways. Primary control is maintained by varying the fluidizing velocity within the aforementioned limits. Such variation raises or lowers the partial pressure of oxygen within the bed 11 which has a direct effect on the rate of combustion. Supplemental to varying the velocity, the amount of oxygen in the fluidizing gas may be adjusted directly by mixing inert or oxygen-depleted gas with the fluidizing air, as described hereinafter. Again, this will have an effect on the partial pressure of oxygen in the bed 11 and, hence, control the combustion rate. The third method of temperature control is to vary the feed rate of raw coal to the fluidized bed dryer 10. An increase in the feed rate increases the heating load and results in a lower temperature since the heat generation remains substantially constant. A decrease in the feed rate has the opposite result.

Start-up of the fluidized coal dryer 10 is achieved by first loading a charge of coal through the screw feeder 15. The coal feed is stopped after the proper bed level is achieved and the bed is fluidized by compressed air from compressor 23. To initiate combustion, the fluidizing gas is heated by a preheater 24 which burns, for example, fuel oil. Once the bed is heated to approximately 400° F., the combustion will be self-sustaining and approximately 75% of the oxygen in the air will react to consume approximately 4% of the coal. The off-gases above the fluidized bed will contain less than 5% oxygen by volume. After a sufficiently high temperature is achieved within the bed, the preheater 24 may be turned off and feed of raw coal through conveyor 15 may be resumed.

The off-gasses from the reaction are collected by both an overhead line 26 and an internal cyclone 27. The cyclone 27 collects those gases which will be used to fluidize a coal bed 30 in the first stage cooler 31. In the cyclone 27, entrained solids are separated from the off-gases and discharged through the bottom back to bed 11. The cleaned gas stream exits through a line 28 and is directed through a port 32 at the bottom of the first stage cooler.

The first stage cooler 31 is another fluidized bed and its construction is quite similar to that of the fluidized dryer 10. The coal bed 30 is supported on a pipe grid 33 which evenly distributes the fluidizing gas beneath the coal bed. Coal is fed to the cooler 31 from two sources. The discharge stream of hot coal from the dryer 10 (line 16) is directed to the cooler below the bed 30. Additionally, a stream of raw coal is directed through a line 36 to the cooler 31 from a raw coal hopper 38, entering just above the bed 30. The two coal streams are mixed by the fluidization of the bed 30, and the sensible heat of the dried coal at 450° F. is transferred to the raw coal whereby the moisture in the raw coal is evaporated. The pressure at inlet port 32 need be only one to five pounds above atmospheric and the fluidizing velocity will be approximately 1.5 feet per second, an amount sufficient to insure adequate mixing of the two coal streams. Temperature control within the cooler may be achieved by varying the feed rate of raw coal through line 36. Temperature in the bed is maintained just above the normal boiling point of water at approximately 220° F.

Coal is discharged from the first stage cooler 31 through line 37 into a second stage cooling vessel 40. The second stage cooler is a large mechanical mixer (typically a paddle mixer) which mixes the dry coal discharged from the first stage cooler 31 with an additional stream of raw coal entering through a line 41. To avoid spontaneous combustion when the product stream is exposed to air, it is necessary to lower the coal temperature to or below about 140° F. The temperature of the coal in the second stage cooler 40 is controlled by varying the flow of raw coal into the cooler. Little evaporation occurs in the second stage cooler, although a small amount of moisture will be carried away by a stream of inert purge gas used for dust control (not shown). As a result, moisture is introduced by the raw coal added and the product stream will have a moisture content typically in the range from 5 to 10%, depending upon the precise moisture characteristics of the coal being processed. The product stream is shown emerging from a line 42 on the flow diagram.

Two-stage cooling allows the hot coal with substantially no moisture content leaving the fluidized bed dryer 10 to be cooled to 140° F. with a minimum addition of moisture. By controlling the bed temperature in the first stage cooler 31 to just above the boiling point of water, the sensible heat lost by the hot coal is used almost entirely to evaporate water from the admixed raw coal. A minimum amount of raw coal is then needed to lower the temperature of final product stream to below 140° F. Since less coal is needed than with one stage of cooling, the product coal will have a lower moisture content.

Returning to the top of the fluidized bed dryer 10, line 26 is seen to direct the remaining off-gases to a cyclone 45. The cyclone 45 effects an initial separation of entrained particles which are then directed through a line 46 to the first stage cooler 31. The off-gases flow from the top of the cyclone 45 through a line 47 to a baghouse 48. The baghouse 48 achieves nearly total removal of particulate matter from the off-gas stream and the majority of the off-gases are then exhausted to the atmosphere through an elevated dispersion stack (not shown). A portion of the off-gas stream, however, is directed via a line 51 through a gas cooler 50. The cooled off-gases are then directed through a water separator 52 and the gases from the water separator are used as a source of inert gas for the system. Inert gas is mixed with air and fed through the compressor 23 to help control the bed temperature in the fluidized dryer 10, as described hereinbefore. The inert gas is also used as a purge gas in the secondary cooler 40.

The fluidizing gas leaves the first-stage cooler 31 via an internal cyclone 54 where primary separation of entrained particulates is achieved. The particulates are returned to the fluidized bed 30 and the cleaned gas stream is directed to the baghouse 48 through a line 55 where it joins the off-gases from the cyclone 45.

As a final means of heat recovery, a small stream of wet coal is mixed with the off-gases from the fluidized bed reactor 10 (line 26) prior to introduction to the cyclone 45. A line 57 runs from coal hopper 17 to line 26, and a high-pressure gas is used to convey the coal stream. The conveying gas may be the inert gas taken from water separator 52 and fed via a small compressor (not shown).

In order that the pressure of the off-gas (line 28) from the fluidized dryer 10 be high enough to fluidize the coal in the primary cooler 31, the off-gas from cyclone 45 is throttled through a control valve 58 operated by a pressure controller (not shown) which controls the pressure in the top of the dryer 10.

AN EMBODIMENT OF THE INVENTION WHEREIN BOTH STAGES OF COOLING ARE ACCOMPLISHED IN A SINGLE MECHANICAL MIXER

Figure 2:
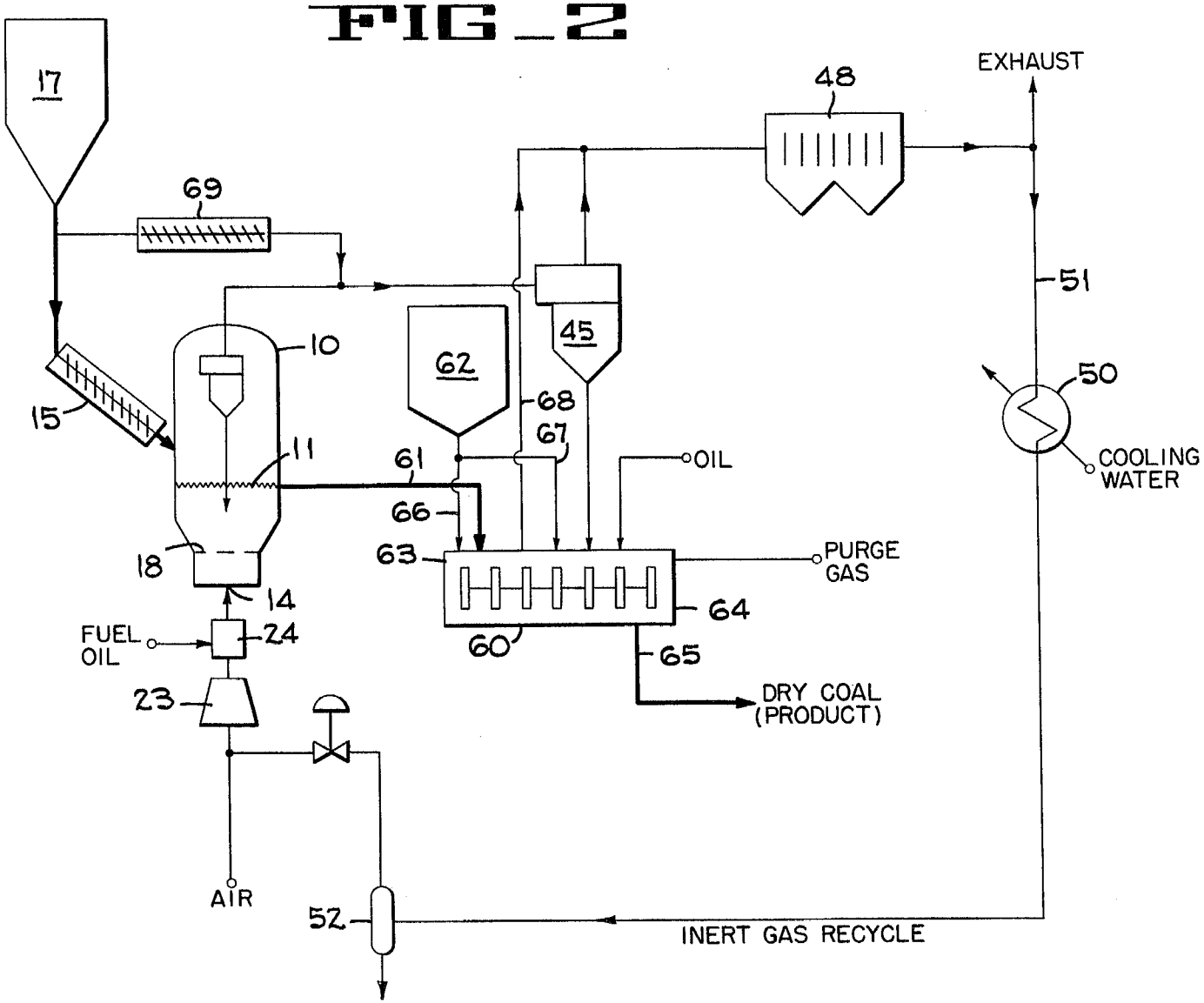
FIG. 2 is a flow diagram illustrating a fluidized bed dryer with both first and second stage cooling accomplished in a single mechanical mixer.

FIG. 2 illustrates an alternate embodiment of the present invention wherein both stages of drying occur in a single mechanical mixer 60. Operation and construction of the fluidized bed coal dryer 10 in this second embodiment is virtually identical to that of the first embodiment, except only one stream of off-gas is taken from the top. The process equipment common to both embodiments will be numbered identically. It may be assumed that the descriptions of such common equipment given in relation to the first embodiment will apply equally well to the second embodiment. Operation of the single mixer 60 will now be described in detail.

Dried coal from the fluidized bed dryer 10 at about 450° F. is discharged directly into the mixer 60 through a line 61, as shown. Raw coal from a raw coal hopper 62 is fed into the mixer 60 at two points along its length. The paddle-type mixer causes material to flow axially from the inlet end 63 where it is joined by line 61 to the outlet end 64 where a discharge line 65 is located.

The first stream of raw coal enters the mixer through a line 66 immediately upstream of the dry coal line 61. The first stage mixing is carried out in the upstream portion of the mixer where sufficient raw coal is added to bring the mixture to approximately 220° F. In this way, substantially all the moisture in the raw coal is removed since the temperature of the raw coal is elevated above the boiling point of water. Additional raw coal is added downstream in the mixer through a line 67 in order to cool the product coal mixture down to or below 140° F. As was the case in the previous embodiment, little evaporation will occur in the second stage of cooling, although the purge gas might pick up some moisture. Near the discharge end of the mixture, oil and oil-coated fines from the baghouse are mixed into the coal (not shown).

The flow rate of both streams of raw coal into the mixer will be controlled on temperature. The first stream 66 will be controlled to maintain a temperature of approximately 220° F. in the first stage of the mixer 60. The second stream 67 will be controlled to maintain a temperature of 140° F. in the second stage of the mixer 60.

Since a substantial amount of evaporation takes place in the mixer, it is necessary that adequate purge gas be supplied to carry away the moisture and avoid condensation in the baghouse. The purge gas is introduced near the discharge end of the mixer (connection not shown) and exits through a line 68 to the baghouse 48. Sufficient purge gas should be provided to maintain a dew point below 140° F. in the purge gas exit stream.

An additional variation over the first embodiment is illustrated in FIG. 2. The raw coal stream to be mixed with the off-gases from the fluidized dryer is fed using a screw conveyor 69 rather than pneumatic conveying. Other than the departures specifically described, the second embodiment is identical to the first.

AN EMBODIMENT OF THE INVENTION WHEREIN DRY COAL IS RECYCLED TO THE FLUIDIZED DRYER

Figure 3:
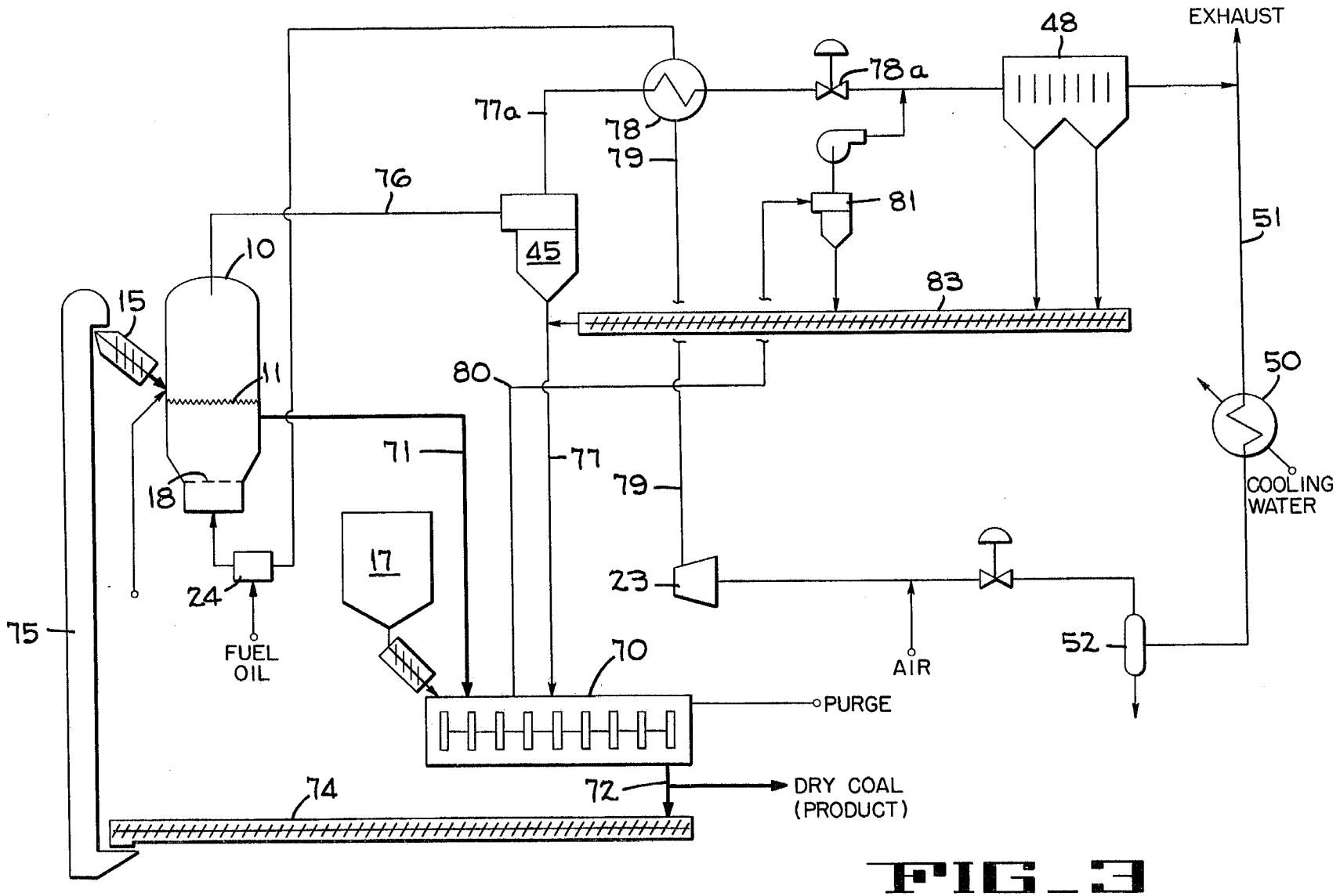
FIG. 3 is a flow diagram illustrating a fluidized bed dryer with recycle of dried product into the fluidized bed.

FIG. 3 illustrates a third embodiment of the present invention intended to dry fine coal, such as found in fine coal filter cake made in many coal cleaning plants. The filter cake consists of coal which is about 28 mesh (0.0232 inches) and smaller, and such fine coal, when damp, flows much less freely than the quarter-inch coal for which the earlier embodiments were designed. Due to the high surface moisture, this fine coal has a strong tendency to cake, as its name would suggest. The drying process has been modified, as will be explained hereinafter, to allow handling of this difficult material. Major process units which correspond to units found in the first embodiment will be numbered identically. It may be assumed that the operation of these units is the same as was described hereinbefore.

The major difference that will be noted between the third embodiment and the two earlier embodiments is that raw coal is not fed directly to the fluidized bed dryer 10. Instead, raw coal is fed from hopper 17 directly into the inlet end of a paddle-type mixer 70, which is similar to the paddle-type mixers of the other embodiments. The raw coal is then mixed with the discharge stream from the dryer 10 which enters through a line 71. By mixing the raw coal with the hot coal from the dryer, the wet fines are partially dried and made free-flowing and become much easier to handle and disperse into the fluidized bed 11. This is not a problem when handling subbituminous coal ground to approximately ¼-inch, as with the previous embodiments, since most of the moisture is contained in fine pores within the coal particles as inherent moisture.

The feed to the fluidized bed dryer 10 is a portion of the product stream 72 emerging from the mixer 70. The feed coal, which is hot and has a moisture content in the range from 5 to 10%, is conveyed by a screw conveyor 74 to a bucket conveyor 75. The bucket conveyor 75 elevates the feed coal to the screw conveyor which is at the inlet to the fluidized bed dryer 10. The conditions inside the dryer are substantially the same as for the previous embodiments. The partial combustion of the coal drives off essentially all moisture and raises the temperature to a temperature in the range of from approximately 400° to 600° F.

As was true of the earlier embodiments, an off-gas stream 76 from the fluidized bed dryer 10 is directed to a cyclone 45 where primary removal of entrained particulates is achieved. These particulates are then directed through a line 77 to the mixer 70. The cleaned off-gases are then directed via a line **77*a* through a heat exchanger 78 where the fluidizing air emerging from compressor 23 and carried by a line 79 is preheated and the off-gases are cooled. The off-gases are then directed through a throttle valve 78*a* and a baghouse 48 for final removal of particulates before discharge to the atmosphere. A portion of the exhaust gases from the baghouse 48 are directed through a cooler 50 and a water separator 52** and become available as the supply of inert gas for the system.

The inert gas is routed through compressor 23 to the fluidized bed 11 in order to accomplish temperature control, as described in connection with the first embodiment. The inert gas is also used to purge the mixer 70 and the purge gases are carried from the mixer by line 80 to a cyclone 81 for primary separation of particulates. The cleaned gas from the cyclone 81 is then directed to the baghouse 48 where it joins the off-gas from the dryer 10. The fines collected in cyclone 81 and baghouse 48 are discharged to a screw conveyor 83 which recycles them to the mixer.

Although the best modes contemplated for carrying out the present invention have been herein shown and described, it will be apparent that modification and variation may be made without departing from what is regarded to be the subject matter of the invention.

What is claimed is:

1. A continuous process for drying particulate coal utilizing heat obtained only from controlled combustion of coal within a fluidized bed of particulate coal after the fluidized bed has first been initially fluidized and raised to a temperature between about 400°–600° F., comprising the steps of:

maintaining fluidization of the particulate wet coal with an unheated fluidizing gas containing oxygen to form the fluidized bed;

maintaining sufficient oxygen for combustion within the fluidized bed so that the bed temperature is controlled within the range between 400° F. and 600° F. whereby the coal is in partial combustion and the temperature is substantially the same throughout the fluidized bed;

withdrawing the fluidizing gas, gaseous coal combustion products and water vapor from above the fluidized bed;

withdrawing dried coal from the fluidized bed;

maintaining said withdrawn dried coal in a substantially inert off-gas atmosphere; and cooling said dried coal to a temperature below 140° F.

2. A process as in claim 1 wherein the fluidizing gas is air and inert gas and the step of maintaining sufficient oxygen within the fluidized bed comprises controlling the air flow velocity.

3. A process as in claim 1 wherein the step of maintaining sufficient oxygen within the bed comprises regulating the amount of oxygen in the fluidizing gas.

4. A process as in claim 1 wherein the step of maintaining sufficient oxygen within the bed comprises varying the flow rate of the fluidizing gas to the fluidized bed.

5. A process as in claim 1 wherein the step of cooling comprises the steps of mixing another stream of wet particulate coal with the fluidizing gas and gaseous combustion products withdrawn from above the fluidized bed so that the other wet particulate coal stream is dried and the fluidizing gas and gaseous combustion products are cooled, and mixing said other dried particulate coal stream with the dried coal withdrawn from the fluidized bed.

6. A process according to claim 1 wherein the withdrawn dried coal forms a first stream and wherein the cooling step comprises:

mixing a second stream of wet coal with the first stream of dried coal to produce a second stream of dried coal, so that said second stream of dried coal has substantially all moisture removed therefrom and has a temperature just above the normal boiling temperature of water; and mixing a third stream of wet coal with the second stream of dried coal to produce a third stream of dried coal, so that said third stream of dried coal has a temperature below the normal boiling temperature of water and a positive moisture content.

7. A process as in claim 6 wherein the step of controlling the bed temperature comprises the step of controlling the rate of oxidation by varying the proportion of oxygen in the fluidizing gas.

8. A process as in claim 6 wherein the step of controlling the bed temperature comprises the step of varying the flow rate of the fluidizing gas to the fluidized bed.

9. A process as in claim 6 wherein the step of controlling the bed temperature comprises the step of varying the feed rate of the first stream of the wet coal to the drying vessel.

* * * * *